United States Patent [19]

Keel et al.

[11] Patent Number: 4,502,299

[45] Date of Patent: Mar. 5, 1985

[54] YARN FEEDER MECHANISMS AND DOUBLE CYLINDER KNITTING MACHINES HAVING SUCH MECHANISMS

[76] Inventors: Frederick Keel, 10 Roy Close, Narborough, Leicester; Keith G. Townsend, 55 Winders Way, Leicester; Marshall C. Carter, 7 Earls Wood Rd., Evington, Leicester, all of England

[21] Appl. No.: 445,056

[22] Filed: Nov. 29, 1982

Related U.S. Application Data

[63] Continuation-in-part of Ser. No. 180,380, Aug. 22, 1980, abandoned.

[51] Int. Cl.[3] ..... D04B 9/10; D04B 9/34; D04B 15/60

[52] U.S. Cl. ..... 66/14; 66/136; 66/140 R; 66/231

[58] Field of Search ..... 66/14, 133, 134, 136, 66/138, 140 R, 231

[56] References Cited

U.S. PATENT DOCUMENTS

| | | | |
|---|---|---|---|
| 2,290,058 | 7/1942 | Manger et al. | 66/140 R |
| 2,470,803 | 5/1949 | Bristow | 66/134 X |
| 3,018,646 | 1/1962 | Wainwright | 66/140 R |
| 3,606,771 | 9/1971 | Peberdy | 66/133 |

FOREIGN PATENT DOCUMENTS

| | | | |
|---|---|---|---|
| 301350 | 11/1928 | United Kingdom | 66/140 R |
| 691674 | 5/1953 | United Kingdom | 66/140 R |
| 1009698 | 11/1965 | United Kingdom | 66/140 R |

*Primary Examiner*—Wm. Carter Reynolds

[57] ABSTRACT

A double cylinder knitting machine has a plurality of pivotable feeders with yarn feeding ends movable through arcs from a trap position, through a feed position to a cross-over park position upstream of the feed position. Movement is imparted to the feeders via a plurality of rotatable cams and cam followers which cause the feeders to pivot upstream of the feed position to an extent sufficient to clear a latchguard and sinkers of the knitting machine followed by further pivotal movement for cross-over and reaching of the park position. The feeders are arrested in predetermined park positions while the cam followers are still on an inclined part of the cams and continued motion of the cams is ineffective after the feeders have reached the park positions.

16 Claims, 8 Drawing Figures

YARN FEEDER MECHANISMS AND DOUBLE CYLINDER KNITTING MACHINES HAVING SUCH MECHANISMS

CROSS-REFERENCE TO RELATED APPLICATIONS

This application is a continuation-in-part of application Ser. No. 180,380 filed Aug. 22, 1980 now abandoned, claiming priority based on British application Ser. No. 7931075 filed Sept. 7, 1979.

DESCRIPTION

1. Field of Invention

The invention relates to double cylinder knitting machines and particularly feeder mechanisms therefor. The invention is especially directed to feeder mechanisms for use at main yarn feeding stations.

2. Background of the Invention

Known "main" yarn feeder mechanisms (see U.S. Pat. No. 1,838,651 and British Patent Specification No. 1,009,698) are difficult to adjust, leading to demanding manufacturing and assembly requirements as well as the need for skilled operators for both the use and assembly of knitting machines employing such prior feeder mechanisms. The detailed arrangements may have to be slightly different for different gauges (needle density), and different cylinder diameters. It may also be necessary to use different drive arrangements (such as cams, cam followers) for different feeders on a particular machine. Adjustments of a delicate nature may have to be effected for different kinds of knitted articles (whether broad-ribbed, rib patterned, or jacquard patterned) so as to ensure that the feeders change over reliably. In addition more feeders are required for modern forms of sock finishing, particularly closing of the toe pouch, which require the incorporation of yarns with widely varying characteristics. Additional feeders can sometimes be accommodated only by using special mechanisms.

One particular form of prior feeder mechanism, described in U.S. Pat. No. 2,290,058, resembles the construction of the present invention superificially but was utilised for the highly specialised purpose of half round striping (knitting different yarns on the top of a foot portion from the yarn in the sole of the foot portion) and required consequential changes and knitting machine arrangement, few of which are described in the said U.S. Pat. No. 2,290,058. The feeder mechanism concerned provided a small overlap between ingoing and outgoing yarns and could only pick up in predetermined areas. Verge bits had to be removed at the needles involved in pick up hindering rib knitting; latchguards and sinkers were cut away and the sinkers retracted temporarily upstream of the location where needles picked up the yarn to enble the feeders to move into and out of the feed position with sufficient clearance. The feeders could collide with one another when the mechanism was not properly set up. Overall the arrangement, although it achieved its special objective, led to cosiderable congestion in the knitting zone at the latchguard and sinkers thereby hampering further adaptation of the mechanism to different types of knitting machines and to different types of yarn and fabric design. Split cams were used to control feeder motion. The mechanism was reqarded as extremely critical in its setting up and use and it fell into dis-use when half-round striping was superseded by other forms of patterning to distinguish the top and sole of foot portions of socks.

It is the object of the invention to provide an improved feeder mechanism. The invention seeks to provide a feeder which both reduces the manufacturing difficulties and enhances the versatility of the feeder in use. It is also the object of the invention to provide a feeder mechanism of simplified construction, capable of simple adjustment and enabling more feeders to be incorporated.

SUMMARY OF THE INVENTION

The invention uses the basic actuation system of the apparatus of U.S. Pat. No. 2,290,058 in that the feeder mechanism has (1) a plurality of pivotable feeders with yarn feeding ends movable through arcs from a trap position, through a feed to a cross-over park position upstream of the feed position, (2) a plurality of rotatable cams and cam followers connected to feeders to impart pivotal movement thereto during a feeder change and (3) means for adjusting the feed positions of the respective feeders. It is to be noted that the pivotal movement is such that the feeder does not clash with the closing needle latches and a movement of the feeders in a radial direction (to clear latches and/or bring a new yarn over the closing needle latches for licking in of the new yarn) is avoided.

According to the invention, the cams and cam followers pivot the feeders upstream of the feed positon to an extent sufficient to clear a latchguard and sinkers of the knitting machine before further pivotal movement for cross-over and reaching of the park position, stop means arrest the feeders in predetermined park positions whilst the cam followers are still on an inclined part of the cams and means are provided for making continued motion of the cams ineffective after the feeders have reached the park positions.

Whereas the apparatus of U.S. Pat. No. 2,290,058 is adapted to give a very short overlap between outgoing and ingoing yarns and the feeders spend only a short time upstream of the feed position during change over, the present invention utilises a more gradual feeder movement whereby the feeders move generally through longer arcs, resulting in a longer overlap between ingoing and outgoing yarns and a smooth change-over. As a longer overlap between ingoing and outgoing yarns may be used, the considerable arc through which some of the feeders move does not lead to the need for a high speed of feeder movement. It may be possible to effect yarn changes at knitting speeds which are higher than usual. By using the present invention, the feeder which has the shortest movement to the park position can be arranged to move well clear of the latchguard and sinkers whilst numerous other feeders can be located for parking further upstream without exceeding the range in which yarns will properly feed or feeders wrap around yarns of other feeders. Consequentially the feeders have a movement at a feed level not only from a feed position downstream for reaching trap positions (as in U.S. Pat. No. 2,290,058) but also movement at a common low level upstream of the feed positions. The movement must in any case clear the latchguard which may have a lower edge bevelled away to facilitate movement of the feeder at the common feed level with sufficient feeder/latchguard clearance. The bevelled latchguard shape also helps to urge the yarn downward as the feeder moves upstream. Advantageously the movement is such that the feeders are clear of the sinkers which are projected radially outward at that stage. This helps to ensure that any up or down movement for cross-over does not significantly alter the yarn pick up conditions in the area where the latches close.

In spite of the use of a considerable arc of movement at a common feed level, the feeders can be parked and crossed over within an additional small arc upstream of the feed position. By using the stop means, a high number of feeders can be parked in separate positions before the full extent of the arc becomes so big that pick-up becomes unreliable for the feeder(s) which has the largest movement upstream. Thus five or six feeders can be accommodated with relative ease and, if required, it is feasible to use seven feeders all operating on the same principle. The close packing of the feeders in the park position is maintained regardless of the precise adjustment of the feeder position. The stop means thus make it possible to provide for a considerable adjustment range without detracting from the close parking arrangement. All the feeders move along the same path past the needles for licking in the yarn. Congestion in this area can be reduced. Conventionally formed latchguards and sinkers may be employed.

Changes in adjustment alter the period which is spent by the feeders in the park position but do not influence the overall duration of the yarn change operation. Feeders can be adjusted in different senses for proper feeding without influencing their joint operation during feeder change operations.

In a preferred form of the invention the feeders are operated by means of Bowden cables which can be adapted to simultaneously provide feeder positon adjustment and compensation for changes in cable dimension. At the same time the cable permits the feeders and cams to be mounted in any desired relative position so enabling good access to the knitting zone to be provided. All adjustment necessary can be effected through the Bowden cables, thus considerably simplifying setting up of the machine compared with older constructions in which a number of separate but interrelated adjustments had to be made. The cables also can function to make continued cam motion ineffective in such a way that the stopping at the park position can be damped. Preferably, therefore, the followers are connected to the feeders by Bowden cables, the length of the cables is adjustable to compensate for changes in cable length and to adjust the feeder position and one end of a sleeve of the cable is supported by resilient means which constitute the means for making excessive cam induced motion ineffective after the feeders have reached the park positions as a result of travelling up a cam slope. The improvement in operation of the feeder mechanism can thus be achieved whilst simplifying the overall construction.

Further stop means are desirably provided to arrest the feeders in predetermined trap positions, excess motion being avoided by lifting the followers off the cams. Thus both park and stop positions can be predetermined regardless of feeder position adjustment whilst the feeder in the trap position is under minimal strain. As a result of the generally large arc of pivotal feeder movement, the trap positions can be located further downstream of the feed positions than usually. Thus the ingoing yarn passes centrally through the area in which the needle latches close even where the feeders are well upstream in the park positions. This also has the added benefit that the needles facing the trappers can be raised for subsequent knitting and hold the loose ends of yarn on the outside of the needles. The ends may be knitted in at the subsequent station but they are in any event on the inside of the finished sock. A further benefit is that the feeders may be spaced well apart in the trap positions facilitating access for threading in yarns.

Advantageously the cams and cam followers for at least some of the feeders are the same and the park and trap positions are differentiated by applying a different leverage from the cam followers to the Bowden cables. The cams can be made to serve all or most feeders of a mechanism and indeed the same cams may be used on different gauges and cylinder diameters. The cams can be shaped to alter the dwell period upstream of the feed position which determines the overlap between the ingoing and outgoing yarns. Preferably the overlap involves approximately 20 needles which is shorter than the overlap required for many known main feeder mechanisms. The feeders can be moved to the trap position at a low speed substantially matching that of the needles so that little additional yarn is drawn from the feeder before the yarn is cut and trapped.

The apparatus of British Patent Specification No. 535,946 used guide plates to superimpose a vertical movement for cross-over and trapping. The present invention uses an analogous control which is known per se but, because the cross-over zone is well upstream of the feed position and substantially clear of the knitting instruments, the tracking can be adapted to optimise feed and pick up conditions and the up/down movement superimposed has less influence on the feeding. Preferably the feed position is adjacent the level of the upper edge of sinkers of the knitting machine and a guide plate is provided for lifting feeders for cross-over after they have moved clear of the latchguard and sinkers. The low feed position enables the needle latches to engage the yarn with increased certainty and the feeder is kept at this secure feeding level for a prolonged period before lifting for cross-over. Even when lifted the bottom edge of the latchguard can guide the yarn and keep the yarn at the secure level. Rib needles can participate in pick-up. Early or late closing of latches due to different yarn tension has little effect on pick-up.

Advantageously the feeders, which have park positions nearer the feed position, are arranged to be raised and then lowered when moving from the feed position to the respective park positions so as to be at the original feed level and at least one feeder more remote from the feed position is arranged to be moved upward just before reaching its respective park position. By differentiating the final parking level in this manner wrapping of yarn at the extreme of the arc of feeder movement can be avoided thus permitting more feeders to be used than when all feeders park at the same level.

Suitably the feeder parked nearest the feed position is a plating feeder suitable for plating in either direction of reciprocation and the plating feeder is arranged to be kept at the same level to move into the park position. The plating relationship is thus not disturbed during a feeder change and the mechanism can be used to give joints, between fabric knitted by the outgoing and incoming yarns respectively, when commencing or ending plating which have a good appearance. Further advantages and preferred features will be apparent from the description of the preferred embodiment.

DRAWINGS

DESCRIPTION OF THE DISCLOSED EMBODIMENT

Figure 1:
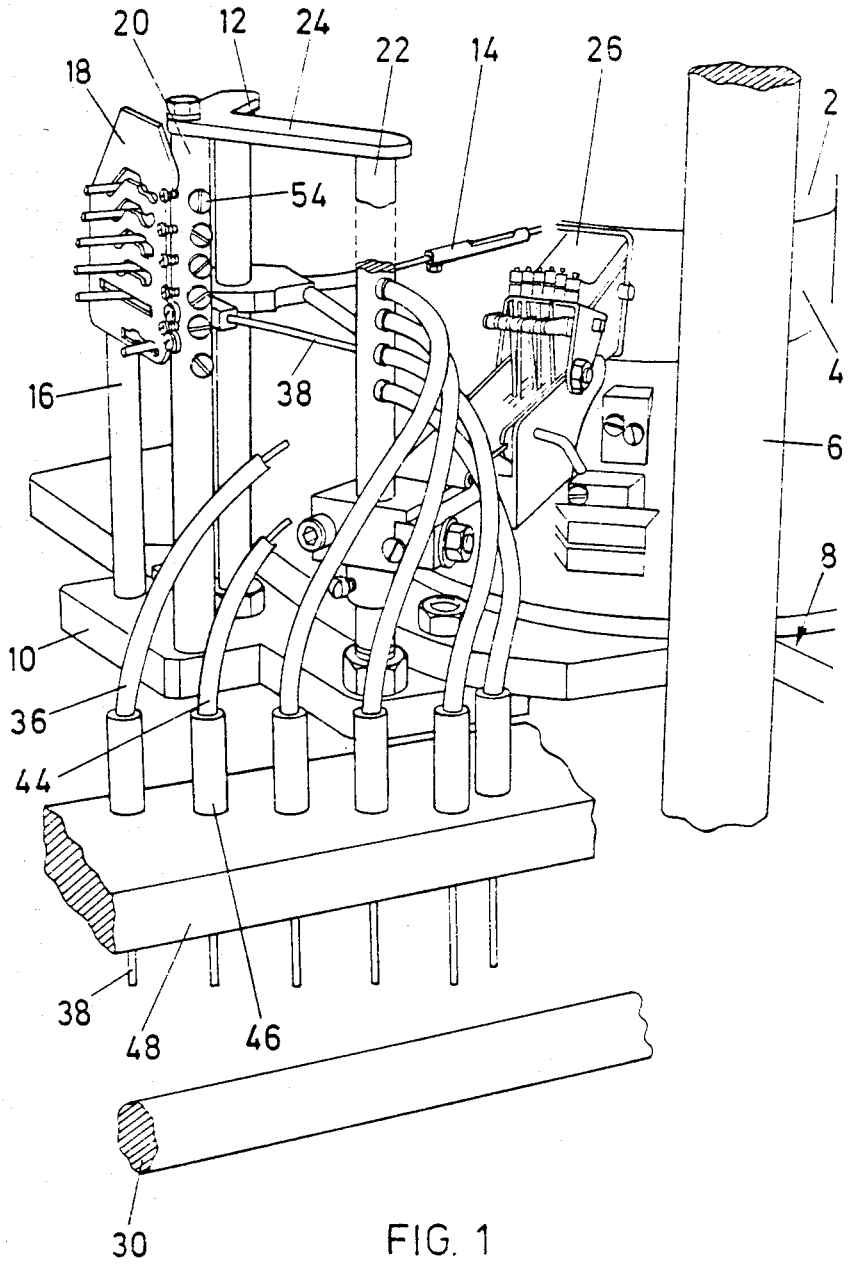
FIG. 1 is a perspective view from the right hand side of a yarn feeder mechanism in accordance with the present invention on a double cylinder knitting machine, certain parts being omitted for clarity.

A double cylinder knitting machine (see FIGS. 1,2,8) has a pair of cylinders 2,4 mounted on top and bottom bed plates (not shown) by pillars 6 (only one of which is shown). Associated with the cylinders 2,4 is a yarn feeder mechanism imcorporating a pre-assembled yarn feeder assembly and a pre-assembled actuator assembly. A latchguard 5 (see FIGS. 2,8) shields the needles.

The feeder assembly is mounted on a middle bed plate 8 and comprises a base plate 10 pivotably mounted on the plate 8 and carrying a post 12 pivotably mounted six feeders 14; a post 16 supporting one side of a slotted tipping plate 18; a post 20 supporting the other side of the plate 18; and a post 22 supporting devices for pivoting the feeders 14. The posts 12,20 and 22 are secured at the top by a bracket 24 for extra rigidity. The post 22 also carries a trapper assembly 26.

The actuator assembly (see FIGS. 1,4) is mounted on the bottom bed plate and comprises the usual components including a shaft 30 mounting a plurality of individually rotatable cams 31 for operating cam followers 32 for the feeders 14 and cams (not shown) and cam followers 34 for the trappers. Bowden cables 36 connect the feeders 14 to the cam followers 32. The wires 38 of the Bowden cables 36 are held taut by tension springs 40 and 42 acting on the feeders 14 and followers 32 respectively. The sleeves or sheaths 44 of the cables 36 are located at one end on the post 22 and at the other end in sockets 46 in a fixed plate 48 of the actuator assembly. The sockets 46 are adjustable heightwise, can be fixed by nuts 47 and contain compression springs 50 for locating the ends of the sheaths 44. The springs 50 resiliently restrain the sleeves 44 against longitudinal movement.

Figure 3:
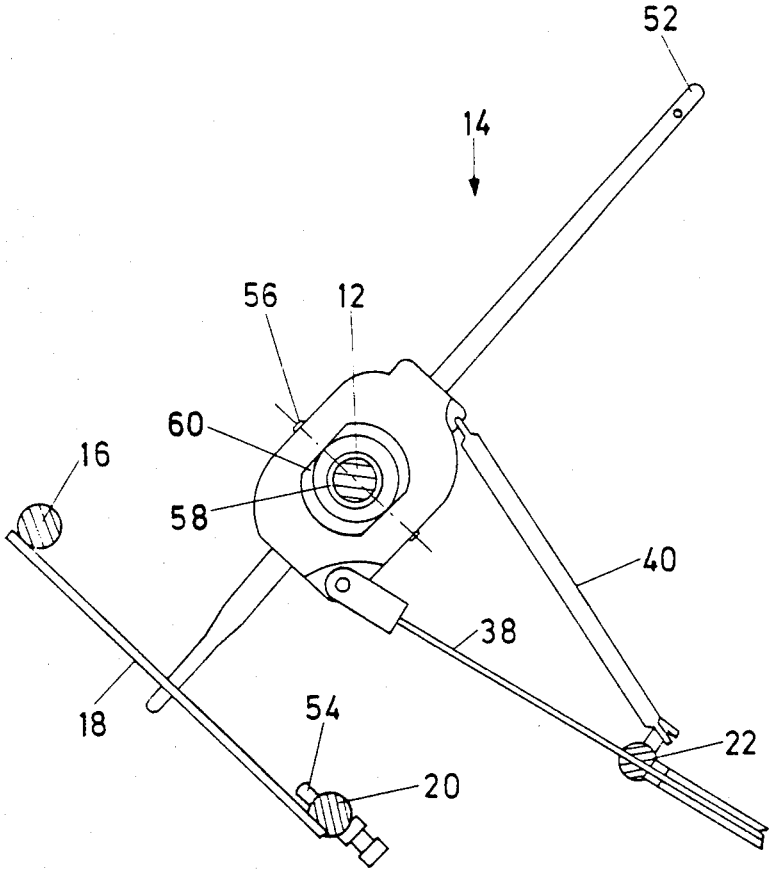
FIG. 3 is a detailed plan view of an individual feeder of the mechanism of FIG. 1.

The individual feeders 14 are thus arranged as shown in FIG. 3. The wire 38 pulls the feeding end 52 to the left against the tension of spring 40 to an extent permitted by the adjustable stop screws constituting the stop means 54 in the tipping plate 18. When the wire 38 is relaxed, the feeding end 52 moves to the right to an extent permitted by the slot in the tipping plate 18. Slots in the tipping plate 18, described in detail later, also impart up/down movement to the feeding end about a pin 56. The feeders 14 are pivotably secured by bushes 58 fixed to the post 12 to hold the feeders 14 apart and by collars 60 pivotable with respect to the post 12 and mounting the respective pins 56. The bushes 58 and collars 60 act as mounting means in the respective feeders.

Figure 4:
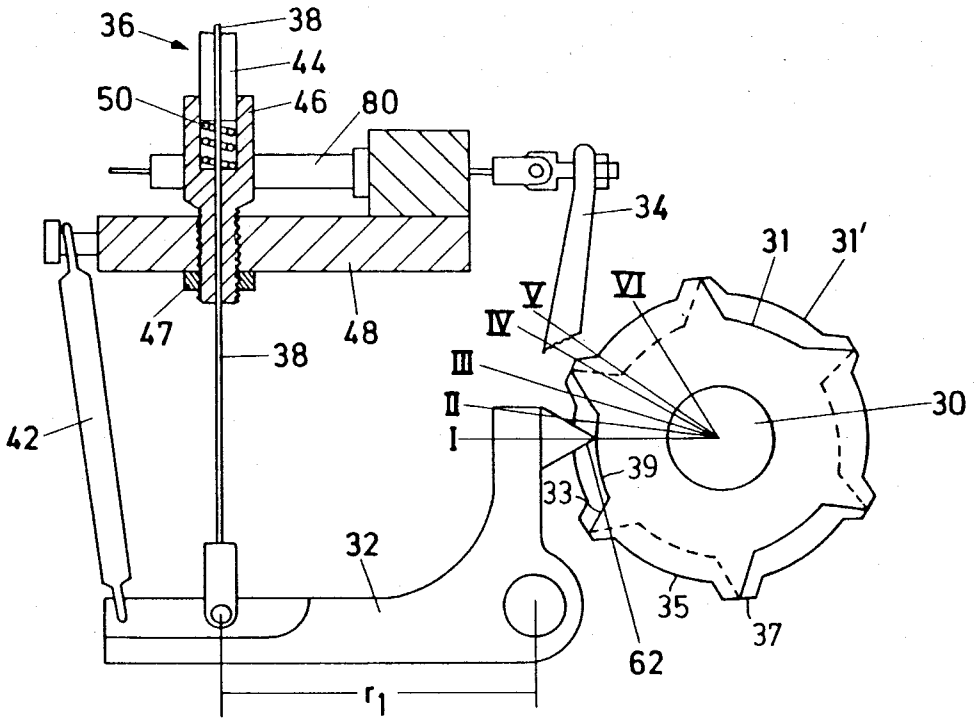
FIG. 4 is a detailed view, partly in section, of an actuator assembly of the yarn feeder mechanism of FIG. 1.

The cam followers 32 are arranged as shown in FIG. 4. The tip 62 of the cam follower 32 is pivoted by the cam 31 to pull the wire 38. The cams 31 for the different feeders 14 are the same. The respective wires 38 are however coupled at different radii ($r_1$) to the cam followers 32. The tension spring 42 urges the tip 62 against the cam 31 when the wire 38 is relaxed as the tip 62 moves radially inward toward the shaft 30. The cam follower 34 for the trappers is operated in a similar way.

Figure 5:
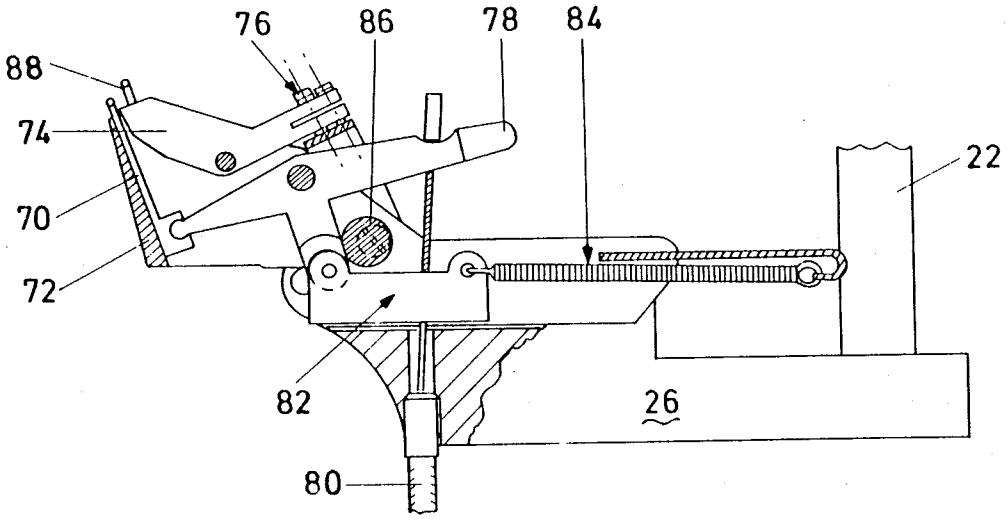
FIG. 5 is a detailed view, partly in section, through a trapper assembly of the yarn feeder mechanism of FIG. 1.

The trapper assembly 26 is as shown in FIG. 5. A trapper blade 70 is movable up or down between a front wall 72 of a housing and pressure levers 74, having pressure adjustment screws 76, by means of a T-shaped lever 78 pivotable by the cam followers 34 and Bowden cables 80. A slide 82 and tension spring 84 urge the blade 70 downwards to an extent controllable by the eccentric 86. The trapper blades 70 have recesses at the top for receiving yarn and trapping and cutting it, aided by the guide wire 88.

OPERATION

Figure 2:
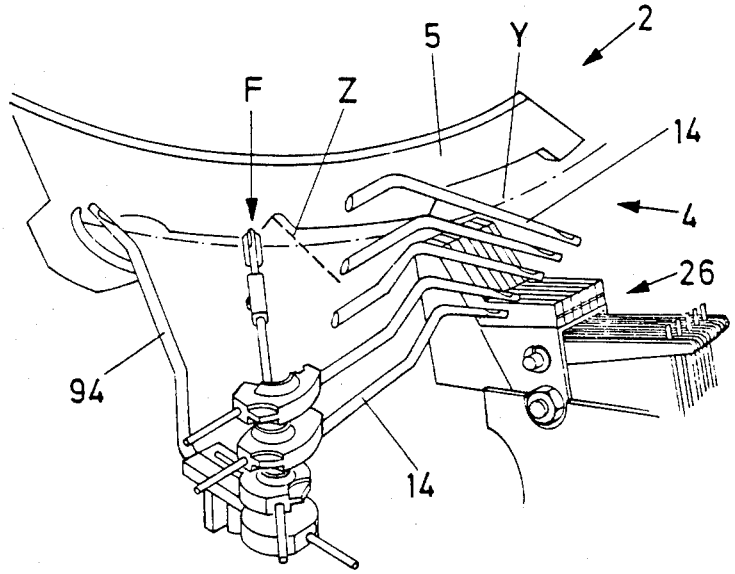
FIG. 2 is a perspective view from behind of the yarn feeder assembly of the mechanism of FIG. 1 showing individual feeders in feed, park and trap positions.
Figure 6:
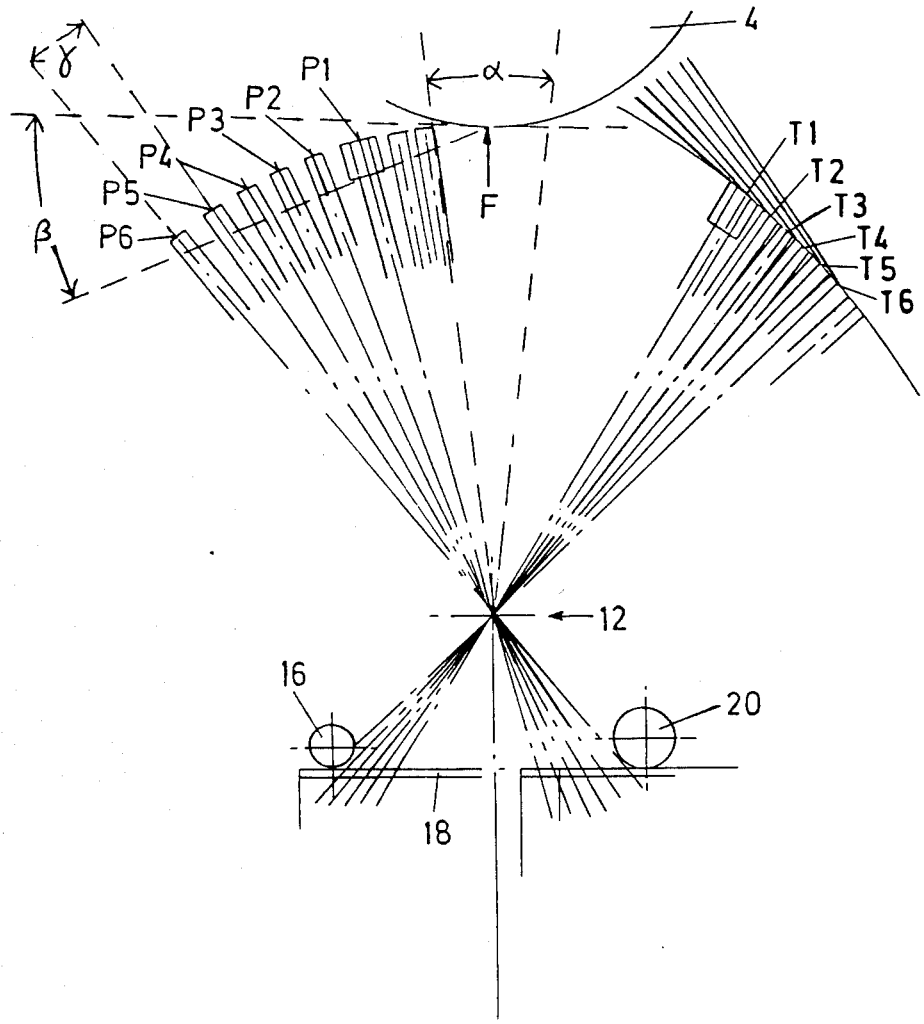
FIG. 6 is a schematic plan view showing the respective park, feed and trap positions of the feeders of the mechanism of FIG. 1.

The cams 31 have such a throw, and the wires 38 are connected to the cam followers 32 at such radii $r_1$, that the feeders 14 are pivotable to provide at least the arcs of motion indicated in FIG. 6. The adjustable stop screws 54 and the extremities 90 of slots in the tipping plate 18 are arranged to locate the feeders 14 precisely in the park and trap positions shown in FIG. 6, park positions being indicated by P, with the suffix indicating the feeder concerned which have been numbered consecutively starting with the lowermost feeder on the post 12. The trap positions are similarly indicated by $T_1 \ldots T_6$. The cams 31 each have a "flat", i.e., a constant radius, cam portion of intermediate height for holding the feeders at a feed position (indicated in an exemplary manner at F in FIG. 6) after the feeders have moved out of the park positions. The feed position is illustrated in FIG. 2, is generally common to the different feeders and is slightly upstream of a V-shaped recess in the latchguard 5. The said intermediate height cam portion 35 has a radius intermediate those of the outermost cam faces 37, formed by the peaks of the cam portion for holding the feeders in their parked position, and that of the innermost cam faces 39, formed by small radius depressed cam portion 30 permitting feeders to move to the trap position as will be explained.

To summarize the operation, the yarns supplied by the feeders 14 will be taken by needles descending, in the direction indicated by the dashed line Z in FIG. 2, from a clearing position as long as the yarn extends generally tangentially from an upstream position. A yarn may extend tangentially past the needles from a trapper at the commencement of feeding or from the needles themselves in the course of knitting. The feed positions can be adjusted individually for each feeder 14 in a circumferential direction by adjusting the sockets 46 to provide the best feeding relationship. Such adjustment does not change the feed and trap positions as will be explained. The positions $P_1 \ldots P_6$ are within such an arc that the yarn will extend generally tangentially to the cylinders 2,4 and pass through the area in which the latches are closed by old loops. Thus the new yarn is reliably licked into the needle hooks.

The tipping plate 18 (see FIG. 7) has six slots 90, i.e., one slot for each feeder 14. The tipping plate 18 and the feeders 14 are arranged relative to one another so that all feeder ends in the feed position are located at the level shown in FIG. 8 over sinkers 92 just at the bottom edge of the latchguard 5. The sinker level is shown by a horizontal dotted line Y in FIG. 2. The tipping plate 18 provides a common movement of all the feeders at this level (as shown by distance $L_1$ in FIG. 7). This distance includes the feed position F as shown by the line F, the adjustment to either side thereof shown by distance $L_2$, and an additional movement to move the feeders 14 clear of the latchguard 5 and the sinkers of the knitting machine, prior to any upward movement for reaching the trap positions or the park positions.

The tipping plate 18 differentiates the movement to the park positions $P_1 \ldots P_6$ in the following way. The lowermost feeder 14 remains at the same level. This feeder is advantageously a plating feeder as shown in FIG. 2 suitable for plating during reciprocation. By holding the lowermost feeder at the same level and imparting the smallest arc of movement thereto, plating is continued when the feeder moves upstream to the park position. The next four feeders 14 move upward in the same part of the knitting machine and then travel horizontally to different extents for lowering to reach the park positions $P_2$,$P_3$,$P_4$ and $P_5$. Although yarns can pass from one parked feeder below another parked feeder 14, wrapping of yarn around the feeders is avoided as the yarn slides to the front of the feeders 14. The largest arc feeder 14 has an initial horizontal movement in an elevated attitude but is then raised further to reach the park position $P_6$. Thus although its yarn can run across other feeders 14 in positions $P_1$ to $P_5$, it cannot wrap around these feeders. Any lifting only occurs where the resultant change in yarn feed angle is small.

Figure 7:
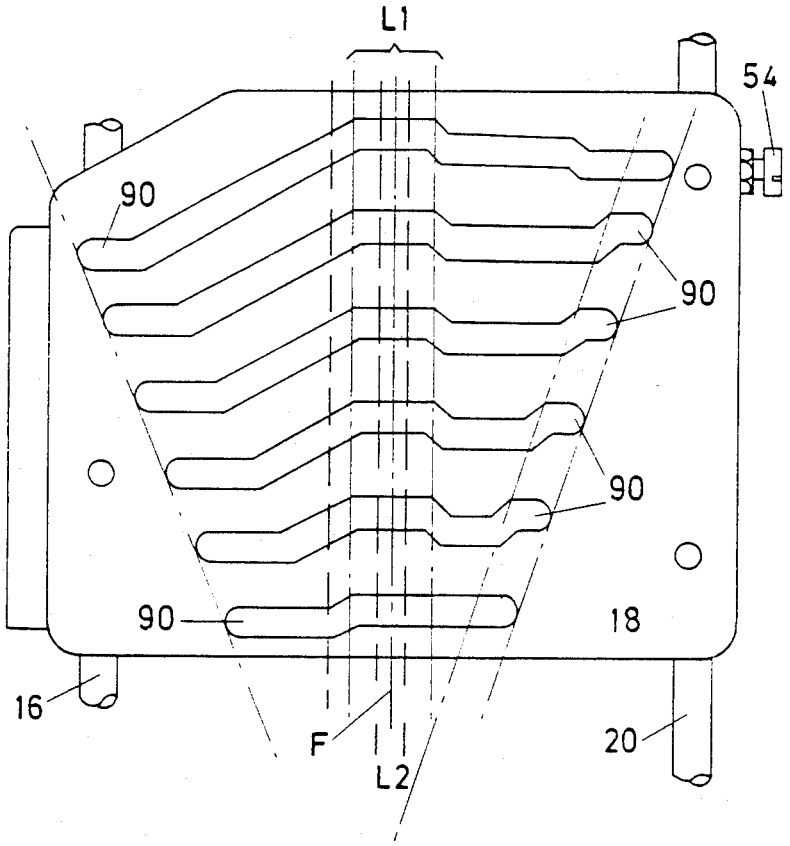
FIG. 7 is a view of a guide plate assembly for controlling pivotal and up/down movements of the yarn feeders.

The tipping plate also differentiates the movement to the trap positions $T_1$ to $T_6$ as can be readily understood from FIGS. 6 and 7. As shown in FIG. 2 an elastic yarn feeder 94 having a retractable feeding end can be located under the feeders 14 and, if present, may be operated by its own particular control means.

A yarn feeder change is effected in a manner generally known per se as the two cams 31 of the actuator assembly are moved through an angle to pivot the outgoing feeder 14 to its park position and then move the feeder 14 coming from the trap position, through the feed position to the park position, lagging behind the outgoing feeder. The incoming feeder starts to feed when it is in the feed position and continues to feed from then on. The outgoing feeder is then moved to the trap position and the ingoing feeder to the feed position with the outgoing feeder leading the ingoing feeder 14. The outgoing feeder ceases to feed when it has moved past the feed position on its way to the trap position. The incoming feeder continues to feed. Successive stages of this operation can be understood by reference to FIG. 4 which shows two cams 31, 31' suitably displaced in stages I through to VI for changing yarns. Thus, when a cam follower 32 is in engagement with the lowest-height-portion 39 of cam 31, the related feeder is in a trap position. As the cam 31 is advanced clockwise, follower 32 will begin to traverse an incline 33. At approximately the midpoint of this incline the related feeder will be at the feed position. When the cam follower reaches the top of the lobe of cam portion 37 the related feeder will be in the park position. As the cam 31 continues to move, the follower 32 will move down the lobe to the cam portion 35 of intermediate height causing the feeder to return from the park position to the feed position.

The end stages of the movement to the park and trap positions are of particular importance. Towards the end of the movement to the park position, the feeder 14 engages the stop screw 54. The cam 31 continues to pivot the cam follower 32 but this movement is now ineffective, the further shifting of the wire 38 merely resulting in a compression of the spring 50 caused by movement of the sleeve 44. Thus, the springs 50 and the sheaths 44 on each of wires 38 cooperate to define a "lost" motion sub-assembly. Towards the end of the movement to the trap position, the feeder 14 engages the end of the respective slot and arrests its movement. The associated cable 38 thus also prevents further lowering of the cam follower 32. The cam follower 32 is consequently lifted from the cam 31 as the cam continues to turn through a small additional angle without effecting the feeders 14. The path of the feeder 14 to the trap position is such that the yarn is placed in the aforesaid recess of the trapper blade 70 aided by the wire 88 leading to the position illustrated in perspective in FIG. 2.

The adjustment of the feed positions can alter the time at which the feeders arrive at the park positions and hence the lapse of time between the arrival of the outgoing and ingoing feeders. However the cams 31 are profiled so that the outgoing feeder always arrives before the ingoing feeder and leaves the park position first to overtake the ingoing feeder so that the ingoing feeder trails the outgoing feeder on moving to the feed position by a considerable distance. This applies also when the lowermost feeder replaces the uppermost feeder. In this case the uppermost feeder 14 departs from the park position sufficiently early to move past the lowermost feeder before the latter moves to the feed position.

In the arrangement described, the time spent upstream of the feed position does not vary between feeders 14 as the cam sector responsible for moving the feeders upstream is substantially the same regardless of the position to which the feeder has been adjusted. What does vary, as explained, is the time spent in the park position which varies a little depending on the adjustment and hence the period of time during which the spring 50 is compressed whilst the feeder 14 is in the park position. There is also a corresponding but inverse change in the amount of time spent moving toward the parked position. The time spent at the common feed level also differs from feeder to feeder regardless of feeder adjustment. This time is considerable for the lowermost feeder and relatively short for the uppermost feeder. The cam 31 should be arranged so that the outgoing feeder is about to enter the common feed level before the ingoing feeder leaves the park position. In this way all eventualities can be accommodated and the precise timing of the movement into and out of the park positions and the common feed level can be ignored in the setting up of the knitting machine.

The relative angle to the cams 31 for ingoing and outgoing yarns can be varied to some extent. However the time spent by both ingoing and outgoing feeders upstream cannot be made too short as the feeders would then have to move so close together that clashing might take place or cams would have to be specially cut for the individual feeders. Thus the overlap must in practice be in excess of approximately 15 needles.

It is particularly to be noted that the maximum feed angle $\beta$ (see FIG. 6) is 20° and provided yarn is fed within this angle continuous feeding is ensured. One side of angle $\beta$ is formed by a line tangential to position F defined hereinafter.

The other side of angle $\beta$ is defined by the line along which a yarn would fall if stretched between the feed position F and a feeding end 52 in its parked position. As noted, the feed angle $\beta$ should not exceed 20° in order to achieve satisfactory feeding. All feeders remain within this angle and continue feeding when moving from the feed position to the upstream cross-over park position. This angle applies to all feeders and is critical. In one reduction to practice of the disclosed embodiment a range of adjustment of the yarn feeders of 10° to either side of position F, which is the feed position on a direct line between the cylinder axis and pivot axis of feeders 14 in FIG. 6, was permitted. If the radius of the feeders is increased the angular movement of the feeder necessary for a given adjustment will become lower. For most applications a total adjustment of 15° is desirable in the interest of avoiding making the feeders unnecessarily long and bulky or unduly restricting the adjustment range.

The regoing requirements normally militate against each other. If the feeder adjustment is 15° then, allowing for the feeder thickness and clearances, the park positions must be mutually spaced by at least 15°. Assuming the use of say 5 feeders, the totality of park positions would occupy an arc of at least 60°. Such a range cannot be accommodated within the angle of movement of the feeders and would be impossible except by exceeding the angle $\beta$ and temporarily interrupting knitting or by further adjusting the feeder movement so as to compensate for the feed position adjustment and ensure that the feeder movement is increased or decreased after feed position adjustment so as to end up close to the desired park position.

The present invention makes the stagger of the park positions $\gamma$ less than angle $\alpha$ by the lost motion means. Thus angle $\alpha$ can be kept high whilst the park positions are retained within angle $\beta$ (see FIG. 6). Angle $\gamma$ is always less than $\alpha$, will be within the range of 4° to 10°, and is in practice 4° for normal feeders and 6° for more bulky plating feeders.

ASSEMBLY

Figure 8:
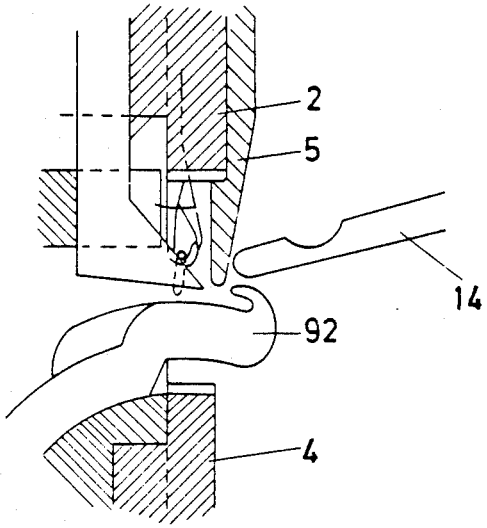
FIG. 8 is a section through the knitting head showing the relative position of the feeders with respect to knitting instrumentalities when in the feed position.

The pre-assembled actuator assembly and yarn feeder assembly are mounted on the knitting machine. The pivotal position of the base plate 10 is adjusted by stop screws to locate the feeders 14 in the feed position at the distance from the needles as shown in FIG. 8. The Bowden cables are attached to interconnect the assemblies. The sockets 46 are adjusted to locate the feeders 14 in the rightmost adjusted feed position. The feeders 14 are then swung to the park positions and the screws 54 adjusted to engage and locate the feeders 14 in the desired park positions appropriately spaced. The feeders 14 can then be returned to the feed positions as indicated by line F. In any adjusted position the feeders 14 will be stopped by the screws 54 and the springs 50. The feeders 14 are arranged to lie just over the sinkers in the feed position as shown in FIG. 8. No further adjustment is necessary.

USE

The feeders 14 can be freely adjusted to take up stretch in the Bowden Cables or adjust the feed position without consequential changes in the park and trap positions.

ADVANTAGES

The actuator assembly and feeder assembly can be simply interconnected and require no prolonged adjustment. Manufacturing tolerances of the cams 31 are less critical. Variations may influence the extent by which one feeder leads another during change-over or the dwell period upstream of the feeder position. The park and trap positions do not require any compensating adjustment. As the feeders perform their cross-over operation upstream of the feed position, yarns from the feeders crossing over continue to be knit during the operation giving a long continuous pick up which can vary to some extent either deliberately as a result of adjustment or as a result of manufacturing tolerances without influencing the quality of the join between ingoing and outgoing yarns.

The aforementioned benefits can be obtained whilst also enabling more feeders to be incorporated than previously. Even though six feeders are employed they can at the same time be made to move through a low level during change-over for a considerable common arc of movement, preserving proper pick up conditions; yet the total arc can be kept within the confines necessary for feeding in the part position and the avoidance of wrapping yarn around other feeders. At least two of the feeders may be bulky plating feeders.

Congestion in the knitting zone is avoided. Sinkers and verge bits may be used as shown in FIG. 8. The latchguard can be solid and utilize a small V-shaped recess. The large arc of maximum feeder movement permits the same cams to give rise to different feeder movement by varying the leverage.

The incidence of loose yarn ends on the outside of socks can be reduced. Change-over speeds may be increased. The presence of float stitches does not require re-timing or re-design as there is a long continuous pick up and a proper join will be obtained even if a group of low inactive needles do not participate in picking up the new yarn.

Advantages of the invention as described also apply to rib knitting. The feeders 14 when in the trap position are relaxed and not in contact with the cams 31 reducing wear.

We claim:

1. In a double cylinder knitting machine, the knitting machine having needle cylinders which define an axis, the machine also having needles with latches, the machine further having sinkers and a latchguard, an improved mechanism for feeding yarn to the needles comprising:

a plurality of individual yarn feeders, said yarn feeders being pivotal about an axis parallel to the axis of the knitting machine cylinders and having yarn feeding ends at first ends thereof;

cam means for each of said yarn feeders, said cam means each comprising a rotatable cam and an associated cam follower, said rotatable cams having intermediate height portions disposed between high and low cam portions and inclines between adjacent of said cam portions;

means for interconnecting each of said cam means cam followers to an associated yarn feeder, said interconnecting means each including a wire extending through a sleeve and means for adjusting the position of a first end of said sleeve to thereby adjust the effective length of said wire, said adjusting means permitting adjustment of the yarn feeders to a desired feed position when in the feeding zone when the associated cam follower is on said intermediate height cam portion, said cam means imparting movement to respective individual associated yard feeders via an interconnecting means to cause the feeding ends thereof to move along a generally arcuate path through the feeding zone, said yarn feeder feeding ends being in close proximity to the needles when in the feeding zone;

a trapper mechanism located downstream of the feeding zone for individually severing and trapping yarn at one end of the paths of movement of said yarn feeder feeding ends;

stop means for arresting the movement of said yarn feeder feeding ends in predetermined parked positions, said parked positions being located upstream of the feeding zone and at the other end of the paths of movement of said yarn feeder feeding ends;

guide means for controlling the movement of the said yarn feeders, said guide means enabling said yarn feeders to pass one another upstream of the feeding zone, said guide means having flat portions for holding said yarn feeder feeding ends at a constant axial position relative to the cylinders when in the feeding zone; and lost motion means associated with each of said yarn feeders, each of said lost motion means including means for resiliently restraining one of said interconnecting means sleeves, said resilient restraining means being stressed to permit the sleeve to move as the wire of said one interconnecting means moves with the associated cam follower to follow a high cam portion and pass a cam incline after the associated feeder has been arrested by a stop means to thereby enable yarn feeder movement to cease when the yarn feeder reaches the parked position while its associated cam follower is on an inclined cam portion and said stop means arrests further yarn feeder motion.

2. The apparatus of claim 1 further comprising arresting means for locating the feeders in predetermined trap positions, said arresting means including means for arresting feeder movement beyond said trap positions.

3. The apparatus of claim 1 wherein said cams are substantially identical and the cam followers are coupled at different radii to the different wires of said interconnecting means whereby the respective feeders are moved through the feeding zones and pivotal movement is terminated at the respective parked and trap position.

4. The apparatus of claim 1 wherein said guide means comprises a plate with slots for guiding the feeders, the slots having inclined parts for moving the feeding ends axially of the needle cylinders after passing through the feeding zone towards their respective park positions except one reciprocating plating feeder whose associated slot remains flat and holds the feeding end at the same level between the parked position and at the feeding zone, the parked position of the reciprocating feeder being nearer the feeding zone than any of the other feeders.

5. The apparatus of claim 4 in which those slots for guiding the feeders which have inclined parts further have oppositely inclined parts to move the feeding ends axially of the needle cylinders back to the same level as the feeding zone level before reaching the parked position except one feeder whose parked position is more remote from the feeding zone than the other feeders whose associated slot has a further inclined part for moving the feeding end axially of the needle cylinders away from the feeding zone level before reaching its parked position.

6. The apparatus of claim 5 further comprising arresting means for locating the feeders in predetermined trap positions, said arresting means including means for arresting feeder movement beyond said trap positions.

7. The apparatus of claim 6 wherein said cams are substantially identical and the cam followers are coupled at different radii to the different wires of said interconnecting means whereby the respective feeders are moved through the feeding zones and pivotal movement is terminated at the respective parked and trap positions.

8. A double cylinder knitting machine including a pair of needle cylinders rotatable about a first common axis, a latchguard, sinkers, a plurality of individually pivotable yarn feeders, the yarn feeders being mounted pivotably for movement about a second common axis substantially parallel to the first common axis of the needle cylinders, the yarn feeders having yarn feeding ends; cam means comprising rotatable cams and cam followers for imparting pivotal movement to the individual feeders about said second common axis, the cams having intermediate height portions between high and low cam portions and inclines extending between adjacent of said cam portions; means interconnecting respective of said cam followers to an associated yarn feeder, said interconnecting means permitting adjustment of said yarn feeders individually and angularly with respect to said second common axis to either side of a line interconnecting said first and second common axes when the respective cam followers are on the intermediate cam portions to thereby determine the feed positions of the yarn feeders, said interconnecting means permitting angular movement of each of the yarn feeders through the feed positions in close proximity to the cylinders to respective cross-over park positions clear of the latchguard and sinkers of the knitting machine and upstream of the feed positions, the cross-over park positions of the respective yarn feeders being mutually staggered and lying within a feed angle bounded on one side by a tangent to the needle cylinders at the feed position which lies on said line interconnecting said first and second common axes, said feed angle being sufficiently small to provide continued feeding throughout the pivotal movement of each of the yarn feeders upstream of their respective feed positions; a trapper mechanism located downstream of the feed positions for individually severing and trapping yarn at a trap position for each of the yarn feeders, stop means for preventing movement of the yarn feeders in an upstream direction beyond the respective cross-over park positions so as to stagger the cross-over park positions of the yarn feeders relative to each other to an angular extent with respect to the second common pivot axis which is smaller than the possible angular adjustment of the individual yarn feeders for determining the feed position; guide means for controlling movement of the yarn feeder feeding ends generally parallel to said first common axis during their pivotal movement about said second common axis for enabling the yarn feeders to pass one another upstream of the feeding position; and lost-motion means to enable yarn feeder movement to cease as each of the yarn feeders engages the stop means when the associated cam follower is still following an inclined portion of its respective cam.

9. A double cylinder knitting machine according to claim 8 having at least five feeders operable for pivotal movement about the common axis by cam means, whose continued upstream movement past the cross-over park positions is prevented by stop means.

10. A double cylinder knitting machine according to claim 9 in which the interconnecting means include, for each feeder, a cable having a wire located in a sleeve, a means for adjusting an end of the sleeve to adjust the feed position of the respective feeder and in which the lost-motion means includes a resilient means resiliently supporting the sleeve, the resilient means being stressed to permit the respective cam follower to mount a high cam portion and pass one of the cam inclines when further movement of the feeder has been prevented by its engagement with the stop means.

11. A double cylinder knitting machine according to claim 10 in which movement of the feeders downstream beyond the respective trap positions is prevented by abutment of the feeders and lifting of the cam followers off one of the cam inclines before reaching the low cam portions.

12. A double cylinder knitting machine according to claim 8 in which the cams of the respective feeders are substantially identical, and the cam followers are pivotable and connected at different radii from the cam follower pivot to the interconnecting means for the respective feeders.

13. A double cylinder knitting machine according to claim 8 in which the feed position is adjacent the level of the upper edge of the sinkers of the knitting machine and the guide means are arranged to lift at least some of the yarn feeding ends for cross-over during pivotal movement about the common axis to move them clear of the latchguard and sinkers.

14. A double cylinder knitting machine according to claim 13 in which at least some of the yarn feeding ends are arranged to be lowered after initial lifting on pivoting the feeders about the common axis to the cross-over park position so as to locate the respective yarn feeding ends at the level occupied by them in the feed position, at least one feeder, having a cross-over park position more remote from the feed positions, being arranged to be lifted by the guide means before reaching its respective cross-over park position.

15. A double cylinder knitting machine according to claim 14 in which the feeder parked nearest the feed positions is a plating feeder suitable for plating in reciprocation and the guide means hold its yarn feeding end at the same level when the feeder is pivoted about the common axis to the cross-over park position.

16. In a double cylinder knitting machine for knitting hose, the knitting machine having needle cylinders which define an axis, needles with latches and further having sinkers in the cylinder and a latchguard, an improved yarn feed arrangement comprising:

at least five individual yarn feeders, said feeders being pivotal about a pivot axis parallel to the axis of the knitting machine cylinders and having yarn feeding ends at first ends thereof;

cam means, said cam means each comprising a rotatable cam and an associated cam follower, said rotatable cams having intermediate portions disposed between high and low cam portions and inclines between adjacent of said cam portions;

means for interconnnecting each of said cam means cam followers to an associated feeder, said interconnecting means permitting angular adjustment of the feeders to a desired feed position in a feeding zone when the cam follower is on said intermediate cam portion, said adjustment being within an angle of at least 15° with respect to the feeder pivot axis to either side of a primary position lying on a line interconnecting the cylinder axis and feeder pivot axis, said cam means imparting movement to the individual feeders to cause the feeding ends thereof to move along a generally arcuate path through the feeding zone, said arcuate paths mutually overlapping and terminating on at least the side upstream of the feed position in mutually staggered positions lying within a preselected angle not exceeding 20° with respect to a tangent to the cylinder having an apex at the primary feed position;

a trapper mechanism located downstream of the feeding zone for individually severing and trapping yarn at one end of the paths of movement of said yarn feeding ends;

stop means for arresting the movement of the feeder feeding ends in predetermined parked positions, said parked positions being at the upstream terminating end of the arcuate movement of the feeder feeding ends, said stop means confining the terminal positions so as to stagger said positions individually at angles of from 4° to 10° with respect to the feeder pivot axis, said parked positions lying within said preselected angle;

guide means for controlling the movement of said feeders, said guide means enabling said feeders to pass one another upstream of the feeding zone, said guide means having flat portions for holding said feeder feeding ends at a constant axial position relative to the cylinders when in the feeding zone; and lost motion means associated with each of said feeders to enable feeder movement to cease when its associated cam follower is on an inclined cam portion and said stop means bars further feeder motion in an upstream direction.

* * * * *